United States Patent [19]

Buergel

[11] 4,096,689

[45] Jun. 27, 1978

[54] HEATING CHAMBER SEAL PROVIDED IN A HEATING CHAMBER COMBUSTION ENGINE

[76] Inventor: Georg Karl Buergel, 6 Stone Rd., Plainview, N.Y. 11803

[21] Appl. No.: 735,825

[22] Filed: Oct. 26, 1976

[51] Int. Cl.[2] ..... F02G 3/02; F15B 15/20

[52] U.S. Cl. ..... 60/39.63; 91/401

[58] Field of Search ..... 60/39.6, 39.63; 91/401

[56] References Cited

U.S. PATENT DOCUMENTS

| | | | |
|---|---|---|---|
| 1,091,389 | 3/1914 | Reese et al. | 60/39.6 |
| 2,449,262 | 9/1948 | Weigel | 60/39.6 |
| 2,688,230 | 9/1954 | Milliken | 60/39.63 |
| 3,844,109 | 10/1974 | Roos | 60/39.6 |
| 3,877,220 | 4/1975 | Girodin | 60/39.63 |

FOREIGN PATENT DOCUMENTS

| | | | |
|---|---|---|---|
| 39,883 | 10/1968 | Japan | 60/39.63 |

*Primary Examiner*—John J. Vrablik

[57] ABSTRACT

A heating chamber seal is provided for a heating chamber combustion engine. A piston is provided with an extension on the flat bottom of the piston which towers upwardly and during the upstroke reaches into a pocket of the cylinder head. The extension has a slit at the bottom of the piston, an opening in the cylinder wall, opening a path to the heating chamber which is located near the cylinder head so that in the highest position of the piston the slit in the piston and the opening in the cylinder wall line up with each other, keeping the opening in the cylinder wall closed in all but the highest position of the piston.

9 Claims, 13 Drawing Figures

HEATING CHAMBER SEAL PROVIDED IN A HEATING CHAMBER COMBUSTION ENGINE

BACKGROUND OF THE INVENTION

A heating chamber combustion engine is an engine such as that shown in my copending application Ser. No. 541,132 filed Jan. 15, 1975, in which a piston, connected to a crankshaft, moves up and down in a cylinder. In the lowest position of the piston the cylinder is flushed and filled with clean air from a loading pump. This is similar to two cycle combustion engines. The clean air is compressed by the up going piston to 1/6 or ⅛ or 1/10 or even less of its original volume. As soon as the piston reaches the position at which the desired compression-ratio is attained, a slit opens, which connects the space above the piston with the interior of a chamber, which is located adjacent to the cylinder. The piston does not stop its motion at this point. It continues to move further up and pushes the compressed air, which was above the piston through the slit into the adjacent chamber. Several cylinders, as many as desired, can be connected to the same chamber.

The air, which is blown into the chamber in the form of a jet stream reaches into the background of the chamber, where it meets a constant burning flame, which is maintained by injection of fuel into the chamber. The chamber is called the heating chamber. The heating chamber walls are covered by a thick layer of ziconium-oxide, which is a very effective insulator against loss of heat and can be used up to 2400° C (4400° F–4600° F). The compressed air in the heating chamber can therefore be heated up to 1500° C or even 2000° C, which is more than double or three times the temperature of the incoming compressed air from the cylinder.

Upon reaching the end of the cylinder the piston reverses its movement and the space above the piston is again increased. The slit, which connects the space above the piston with the interior of the heating chamber remains open to the same position of the piston, where it was opened before. Therefore, the space above the piston is filled with hot air, which came from the foreground of the interior of the heating chamber.

An equal amount in weight must leave the heating chamber as was blown in earlier. Since the air, which was blown in had a much lower temperature it had a smaller volume. In order to get the same amount of air in weight out again, the pressure of the outcoming air has to be much higher. This means that the pressure in the heating chamber adjusts itself to the temperature of the outcoming air. This pressure is much higher than the pressure, which was achieved above the piston when the air was compressed to 1/6 or ⅛ or 1/10 of its original volume. So, when the slit opens at this position a much higher pressure in the heating chamber will be encountered, which will raise the pressure above the piston to the pressure in the heating chamber. The piston must from then on push the whole cylinder content against this higher pressure into the heating chamber. The energy, required to do this is returned to the piston, when the much hotter air from the heating chamber returns at the down stroke to the piston until the slit closes again. The expansion of the hot air above the piston starts from the high pressure level of the heating chamber.

SUMMARY OF THE INVENTION

The subject of the present invention is the connection and the sealing between the cylinder and the heating chamber of such an engine.

Opening and closing of the slit, which makes the connection between the cylinder and the heating chamber during a small portion of the stroke of a piston, requires a very high opening and closing speed especially at high RPM of an engine. The time required, is much too short to be managed by a valve. Besides, a valve can not handle hot and very hot gases except of course it is made from very special material. A sliding plate with a slit opening can readily achieve very high opening and closing speeds and can handle very hot gases since the streaming gases do not touch the sealing surfaces. The inside of the slit can be covered with high heat resisting and low conducting material like plasma sprayed 20% inconel with 80% zirconium-oxide or other ceramic inserts. The sealing surface slides along hot gases but since the hot gases are stationary and their heat capacity is very small and since the contact area is moving, the temperature increase of the sliding and sealing plate is very small so that even a material such as aluminum can withstand it.

DETAILED DESCRIPTION

Figure 4:
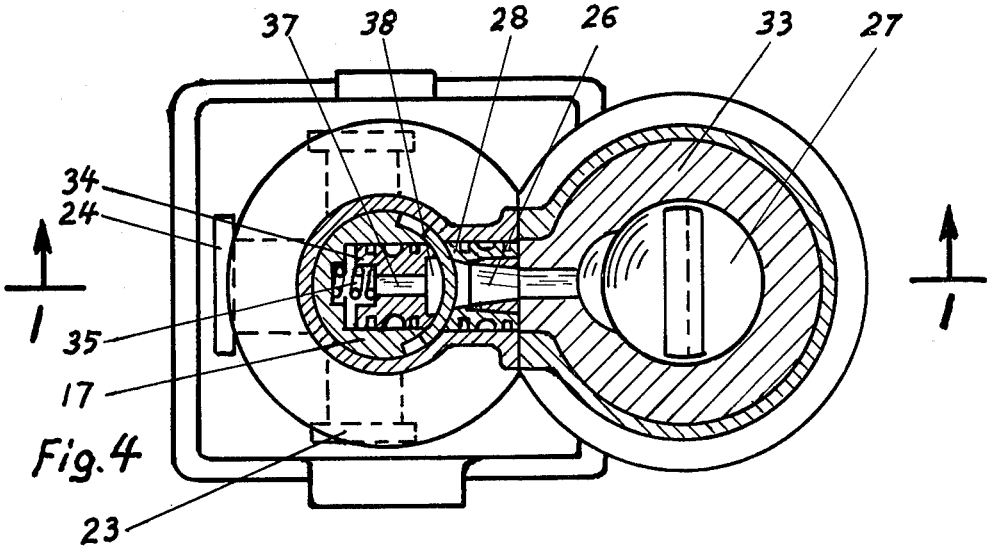
FIG. 4 is a section taken along the line 4—4 through the one cylinder heating chamber engine of FIG. 1 showing the sealing arrangement.
Figure 3:
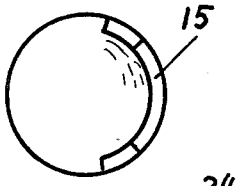
FIG. 3 is a view of the piston from above.
Figure 2:
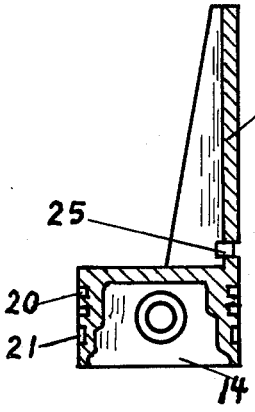
FIG. 2 is a cross section through a piston provided with the sealing extension.
Figure 1:
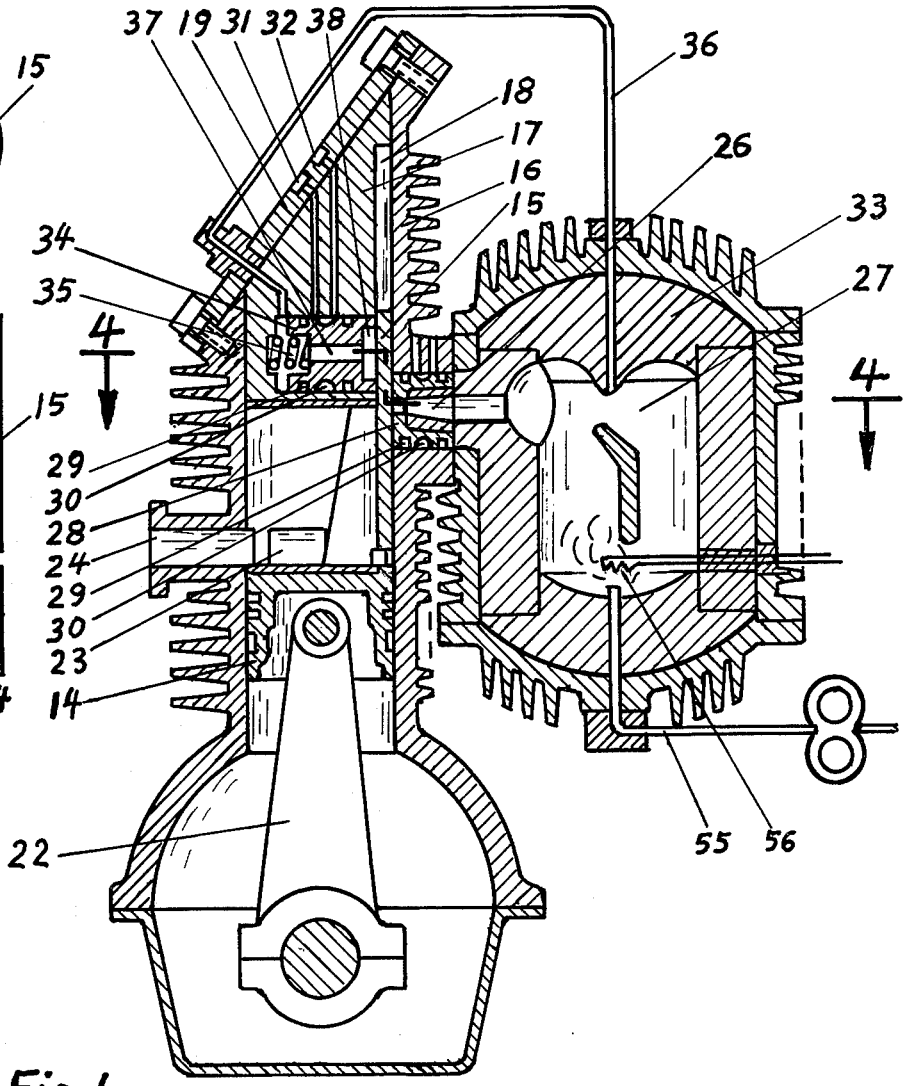
FIG. 1 is a cross section through a one cylinder heating chamber combustion engine using the sealing mechanism which is the subject of this invention.

As shown in FIGS. 1, 2, 3 and 4, piston 14 carries an extension 15 which is part of the piston and slides along the wall of the cylinder 16. The cylinder is closed on top by a cylindrical insert 17, which has a cut-out 18 at one side to provide just enough space to accommodate the extension 15 of the piston in its highest position. The cylindrical insert 17 provides a tight fit so that in the highest position of the piston almost no air-space is left between the piston and the cylindrical insert 17. The cylindrical insert 17 and the cylinder 16 are cut at an angle on top to save weight and material and are screwed to and sealed to the outside by a coverplate 19. The piston 14 carries piston rings 20, an oil ring 21 and is connected to a crankshaft by a connecting rod 22. The piston 14 uncovers in its lowest postion two inlet ports 23 and one exhaust port 24. In the piston extension 15 is a slit 25, which communicates in the highest position of the piston 14 with the path 26 to the heating chamber 27. In any position other than the highest the piston extension 15 keeps the path 26 closed.

In order to provide an effective sealing the path 26 is placed inside of a small sealing piston 28, which is contoured to fit to the radius of the piston extension 15 and which is pressed against the surface of this extension 15 by the gas pressure in the heating chamber 27. The sealing piston 28 carries piston rings 29 to provide sealing in its housing. Between the piston rings 29 is located a groove 30 through which oil is circulated under pressure for lubricating, sealing and cooling through the borings 31 and 32. The diameter of the sealing piston 28 is made as large as possible to accommodate a wide path 26 and provide space for heat insulation material like zirconium-oxide 33.

The piston extension 15 is exposed to a one-sided pressure from the sealing piston 28. This force can be absorbed by the cylindrical insert 17. The piston extension 15 slides along the surface in the cut-out 18. This force can be compensated for by using another small piston, support piston 34, which is built into the cylindrical insert 17. Support piston 34 is similar to the sealing piston 28. It also carries piston rings 29 and has a groove 30 which also is supplied with pressure oil for lubrication, sealing and cooling. One end of it is fitted to the hollow side of the piston extension 15 onto which it is pushed by a spring 35 but mainly by the air pressure behind the support piston. The air pressure is led to this space through a tube 36 which is connected to the heating-chamber 27. The backside of the piston extension can also be made flat for simplification, but that may have the disadvantage of a somewhat longer slit 25. It is the choice of the designer.

Figure 6:
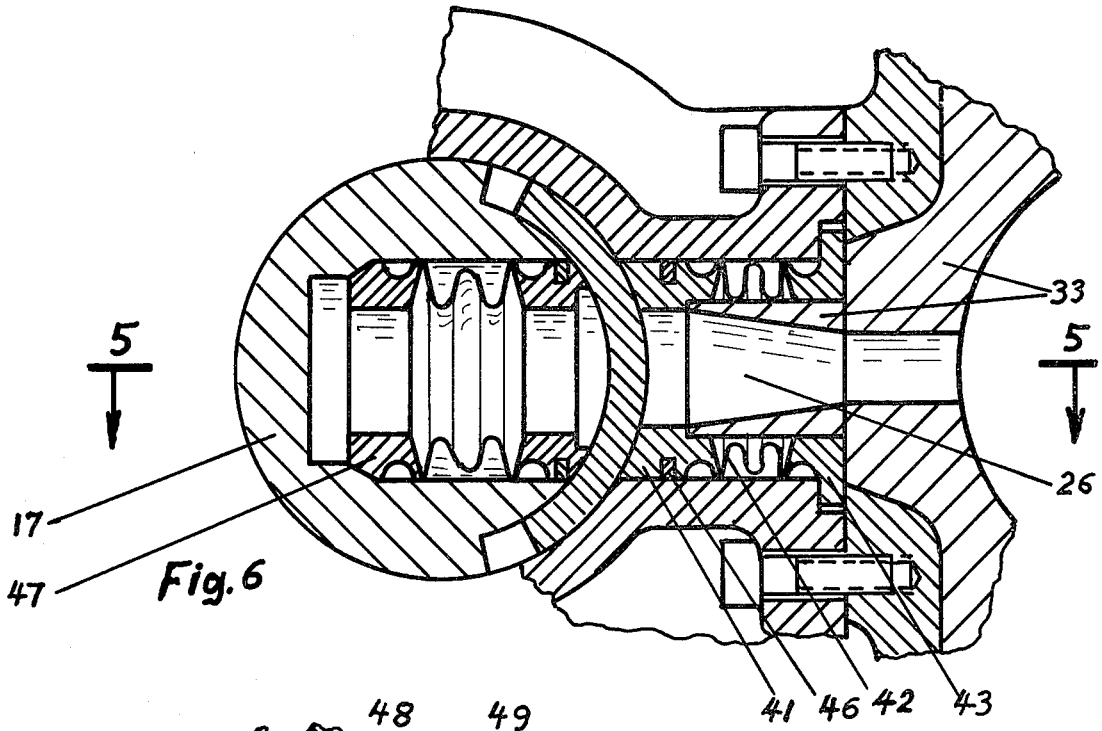
FIG. 6 is a section taken along the line 6—6 in FIG. 5.
Figure 5:
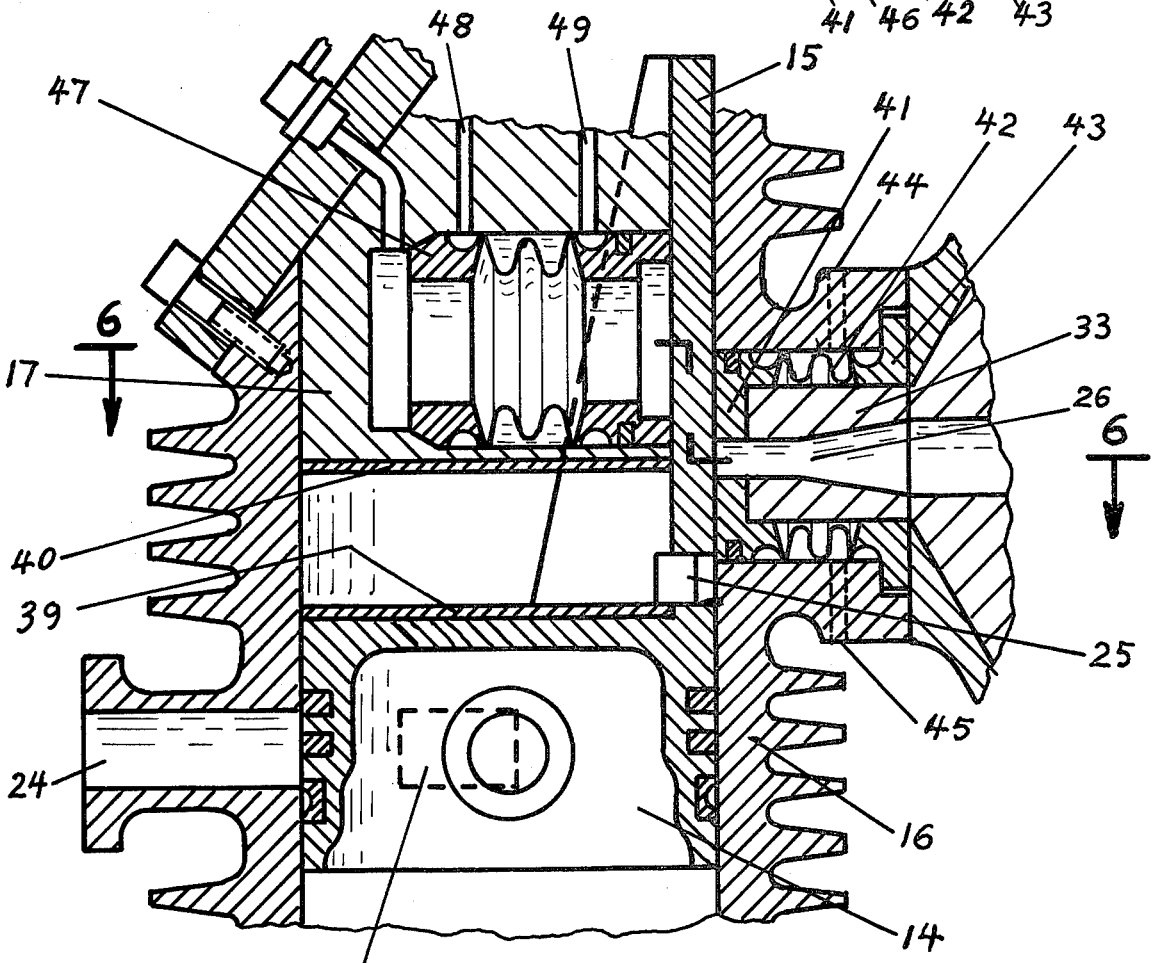
FIG. 5 is a section takken along the line 5—5 of FIG. 6 showing a different type of seal which uses a metal bellows.
Figure 10:
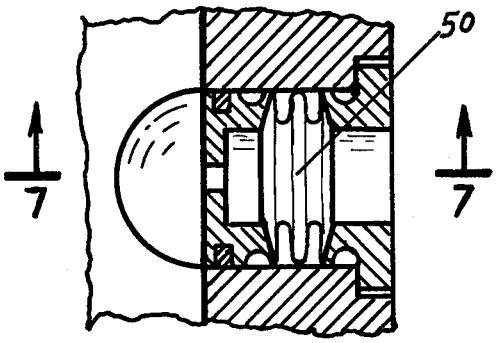
FIG. 10 is a section taken along the line 10—10 in FIG. 7.

In order to decrease the friction and wear, a hole 37 and a recess 38 is provided in the support piston 34. By this the air pressure acts directly on the piston extension 15 to compensate most of the force from the sealing piston 28. A smaller part of the force is carried by the rim around the recess 38. FIG. 5 and FIG. 6 show the piston 14, the piston extension 15 and the sealing elements in a somewhat enlarged scale. The surface 39 of the piston 14 and the bottom 40 of the cylindrical insert 17 is shown to be covered with insulating material against loss of heat. This can be done since no combustion takes place in the cylinder and no deposits will accumulate.

The seals which are shown in FIGS. 5 and 6 use metal bellows. A sealing element is assembled from a ring 41 to which a stainless steel bellows 42 is welded to which in turn a flange ring 43 is welded. The bellows 42 can be made to withstand high pressure since very little deflection and no movement is required. A bellows can also be made two or three ply. A portion of the inside pressure can be compensated by supplying oil under pressure to the outside of the bellows through bore 44. The oil cools the bellows, lubricates the sliding surface and leaves again through bore 45 and still held under pressure. The ring 41 carries a piston ring 46 to prevent escaping of too much oil for lubrication. The sealing assembly is made so that the bellows 42 is compressed very little when in operating position. The pressure from the inside tends to stretch it even more, thereby insuring a good seal at the surface, which slides along the piston extension 15.

A similar sealing assembly 47 is used to support the piston extension 15 from the back side. Here also, oil is supplied under pressure through the bores 48 and 49 for lubrication, cooling and pressure compensation.

Figure 11:
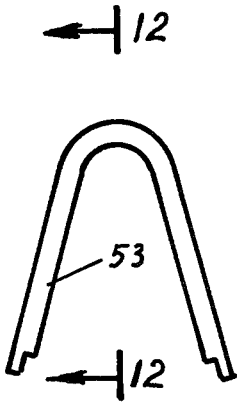
FIG. 11 is a hairpin sealing piece.
Figure 12:
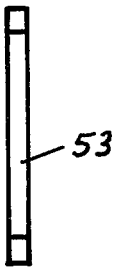
FIG. 12 is a section taken along the line 12—12 through a hairpin sealing piece in FIG. 11.
Figure 13:
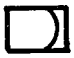
FIG. 13 is an end view of a hairpin seal with the space for a spring.
Figure 7:
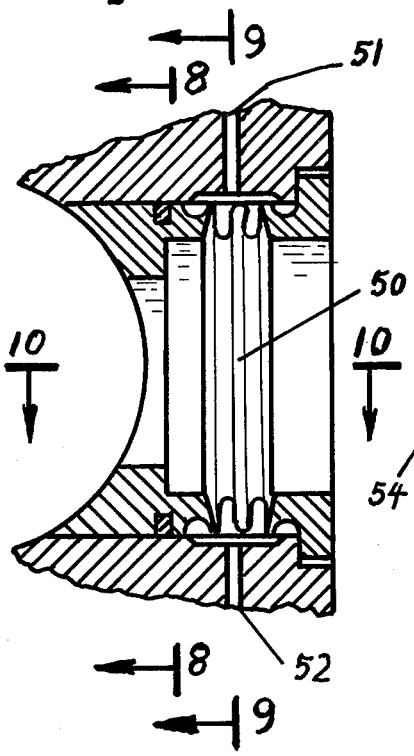
FIG. 7 is a cross section through a seal, which is elongated to permit the use of a wide path with little height.
Figure 8:
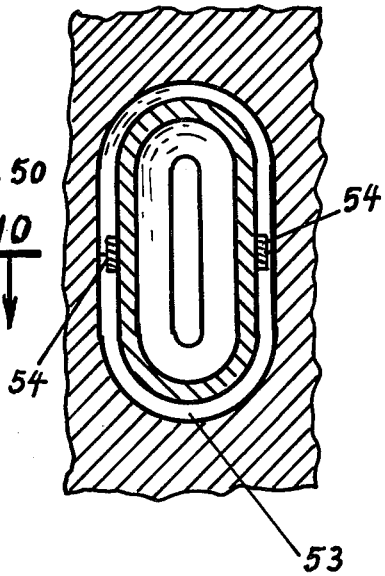
FIG. 8 is a section taken along the line 8—8 in FIG. 7.
Figure 9:
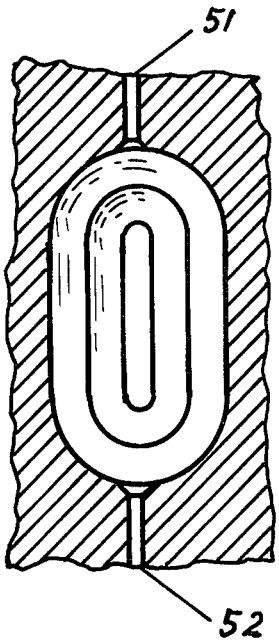
FIG. 9 is a section taken along the line 9—9 in FIG. 7 showing a substitute for a piston ring, which consists of two hairpin-like pieces.

In order to achieve high engine speed it is advantageous to have the path 26 as wide as possible and smaller in height. To this purpose a seal such as that shown in FIG. 7 can be used. A bellows 50, which is used here, has to be stretched after heat treatment to assume a shape as shown. The flat sides can withstand the inside pressure because they are supported by the housing. There is also oil supplied under pressure through the bores 51 and 52, FIG. 9 for the same purpose. In order to restrict the flow of oil for lubrication two hairpin pieces 53 FIG. 8 inserted in a groove are used in place of a piston ring. The hairpin pieces 53 FIG. 11, 12 and 13 are formed so as to have spring tension directed to the outside when in operating position. Small springs 54 are inserted between the ends of the hairpin pieces to insure sealing at both ends.

I claim:

1. In a combustion engine comprising a housing, a cylinder defined within said housing, a piston disposed for movement sithin said cylinder, a heating chamber defined within said housing, a fuel inlet and fuel igniting means in said heating chamber, a passageway disposed within said housing connecting said heating chamber and said cylinder interior adjacent the cylinder head; that improvement including an extension of said piston for slidable movement on the wall of said cylinder above said piston, an opening provided in said extension constructed and arranged so that the opening in the extension and said passageway line up with one another solely in the highest position of said piston whereby the gases within said cylinder pass into said heating chamber through said passageway at the end of the compression stroke and return from said heating chamber to said cylinder through said passageway at the beginning of the down stroke of said piston in a reciprocating motion.

2. A combustion engine in accordance with claim 1 in which a pocket is provided in the head of said cylinder to receive said extension during the upstroke of said piston.

3. A combustion engine in accordance with claim 1 in which a sealing piston is provided in said housing in which said passageway is formed, said sealing piston having a contoured surface of the radius of said piston extension and which is yieldingly urged against the surface of said extension by gas pressure within said heating chamber.

4. A combustion engine in accordance with claim 3 in which said sealing piston carries piston rings for sealing with said housing and lubrication means is provided to lubricate the outer surface of said sealing piston.

5. A combustion engine in accordance with claim 4 in which said sealing piston is formed as a bellows.

6. A combustion engine in accordance with claim 5 in which said sealing piston is elongated on its horizontal axis providing substantially flat sides parallel thereto.

7. A combustion engine in accordance with claim 3 in which a support piston is provided in said housing and is yieldingly urged into abutment with said extension in the direction opposed to that of said sealing piston.

8. A combustion engine in accordance with claim 7 in which air from said heating chamber is passed through a conduit to impinge upon said support piston and provide force directing said piston into abutment with said extension.

9. A combustion engine in accordance with claim 7 in which said support piston is formed as a bellows.

* * * * *